US005139429A

United States Patent [19]

Herman et al.

[11] Patent Number: 5,139,429

[45] Date of Patent: Aug. 18, 1992

[54] ELECTRICAL CONNECTOR LOCKOUT DEVICE

[75] Inventors: Wallace U. Herman, Fairfield; Patrick J. Tiberio, Huntington, both of Conn.

[73] Assignee: Hubbell Incorporated, Orange, Conn.

[21] Appl. No.: 770,918

[22] Filed: Oct. 4, 1991

Related U.S. Application Data

[63] Continuation of Ser. No. 655,810, Feb. 15, 1991, Pat. No. 5,061,194.

[51] Int. Cl.[5] ..... H01R 13/44

[52] U.S. Cl. ..... 439/133; 439/368

[58] Field of Search ..... 439/133, 134, 367, 368, 439/372

[56] References Cited

U.S. PATENT DOCUMENTS

| | | | |
|---|---|---|---|
| 4,381,063 | 4/1983 | Leong | 439/133 |
| 5,052,939 | 10/1991 | Koch | 439/133 |
| 5,061,194 | 10/1991 | Herman et al. | 439/133 |

*Primary Examiner*—Paula A. Bradley

*Attorney, Agent, or Firm*—Jerry M. Presson; Walter C. Farley

[57] ABSTRACT

A lockout device for enclosing and inhibiting unauthorized access to an electrical connector attached to an electrical cable has first and second identical joinable shell portions each with a concave interior so that when the shell portions are joined the interiors define a cavity for receiving an electrical connector. Each shell portion has a hinge pin and a hinge clevis for connection to a hinge clevis and a hinge pin, respectively, on the other shell portion to pivotally join the shell portions so that they are pivotable between open and closed positions. Male and female latch members engageable with similar members on the other shell portion are provided to hold the shell portions in the closed position. Arcuate recesses at opposite ends of the said shell portions form a circular opening, when the portions are joined, to permit a cable attached to the connector contained in the cavity to extend out of the housing.

7 Claims, 3 Drawing Sheets

ELECTRICAL CONNECTOR LOCKOUT DEVICE

CROSS REFERENCE TO RELATED APPLICATIONS

This is a continuation of copending application Ser. No. 07/655,810 filed Feb. 15, 1991, now U.S. Pat. No. 5,061,194.

FIELD OF THE INVENTION

This invention relates to a lockout device for enclosing an electrical connector attached to an electrical cable for inhibiting unauthorized access to the connector for safety purposes.

BACKGROUND OF THE INVENTION

Recognition of the danger of electricity to persons in a work place having electrical equipment is certainly not new, but new emphasis has been placed on this danger, as well as steps to reduce risk, by regulations recently adopted by the Occupational Safety and Health Administration, U.S. Department of Labor. In 29 CFR Part 1910 are standards and procedures for reducing risks of injury to employees resulting from the unexpected energization or start-up of machines or equipment, or the release of stored energy. While the regulations are applicable to energy more broadly than just electrical energy, electricity is clearly one form of energy involved.

The regulations provide, in part, that employers are to have available lockout and tagout devices which can be used to reduce risks of electrical shock. One form of shock hazard relates to electrical cords or cables. For example, if a power cord is connected to a machine such that the machine is supplied with energy when a plug on the cord is inserted into a live receptacle, and if the machine is to be worked on, a prudent maintenance person would remove the plug from the receptacle before starting the work. However, it is possible for another person to restore the plug to the receptacle without realizing that the work is being performed, thereby subjecting the maintenance person to risk of shock. This is particularly applicable when the machine and the receptacle are not close to each other, or within sight of each other. The purpose of 29 CFR 1910 is to encourage the development and use of lockout devices which are designed to prevent such events, among others.

As will be apparent, a related source of serious physical injury can result from the unexpected start-up of machinery which has moving blades or activated presses, meshing gears or the like while the maintenance person is working on the machinery. While this does not involve electrical shock, the result is often no less serious.

SUMMARY OF THE INVENTION

Accordingly, an object of the present invention is to provide a lockout device which can be employed to enclose an end of a power cord having a connector attached thereto.

A further object is to provide a lockout device which can be locked in a closed position, enclosing the connector, such that access to the connector is prevented without a key, combination or the like to open the lock.

Yet another object is to provide such a device which can also receive a tag having indicia thereon making it clear that the connector should not be attached to a source of power or that the lock is to be removed only by the person who placed the lock in position.

A still further object is to provide a lockout device which includes identical halves which can be assembled to form a complete lockout enclosure, thereby providing a structure which is inexpensive and easy to produce and yet sturdy and reliable.

Briefly described, the invention comprises a lockout device for enclosing and inhibiting unauthorized access to an electrical connector attached to an electrical cable and has first and second identical joinable shell portions, each with a concave interior, so that when the shell portions are joined the interiors define a cavity for receiving an electrical connector. Each shell portion has a hinge pin and a hinge clevis for connection to a hinge clevis and a hinge pin, respectively, on the other shell portion to pivotally join the shell portions so that they are pivotable between open and closed positions. Male and female latch members engageable with similar members on the other shell portion are provided to hold the shell portions in the closed position. Arcuate recesses at opposite ends of the said shell portions form a circular opening, when the portions are joined, to permit a cable attached to the connector contained in the cavity to extend out of the housing.

BRIEF DESCRIPTION OF THE DRAWINGS

In order to impart full understanding of the manner in which these and other objects are attained in accordance with the invention, a particularly advantageous embodiment thereof will be described with reference to the accompanying drawings which form a part of this disclosure, and wherein.

DESCRIPTION OF THE PREFERRED EMBODIMENT

Figure 1:
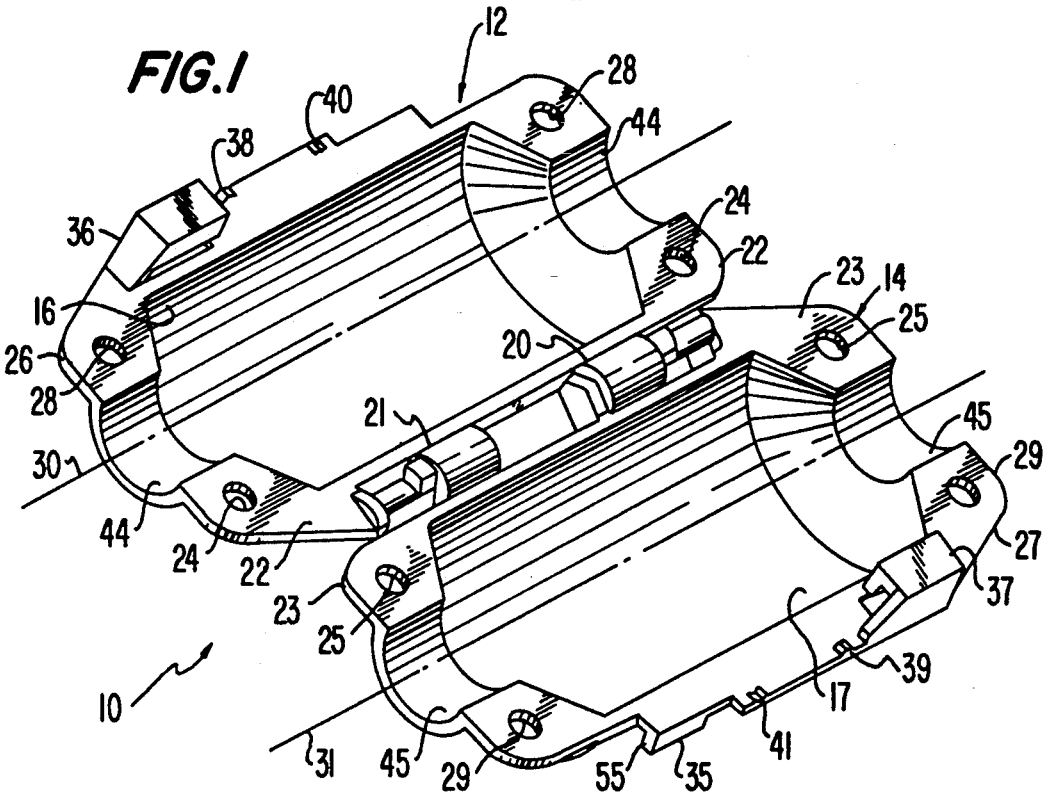
FIG. 1 is a perspective view of a lockout device comprising two substantially identical shell portions which are hinged together and shown in an open position.

Referring first to FIG. 1, a lockout device in accordance with the invention comprises a housing indicated generally at 10 which includes first and second joinable shell portions 12 and 14. In the particular embodiment shown, these shell portions are identical so that only one article needs to be produced. This is certainly the preferred embodiment since manufacturing is thereby greatly simplified, although it is clearly possible to make a device similar to the embodiment shown without the shell portions being absolutely identical. In the following description, even though the shell portions are identical, like components on the two portions will be identified by different reference numerals so that the manner in which they are assembled and joined can be more clearly understood.

Each shell portion has a generally cylindrical body 16, 17 with a concave, substantially cylindrical inner surface so that, when the shell portions are put together with the concave inner surfaces facing each other, the two shell portions define a cavity within which an electrical connector can be received and enclosed.

Figure 2:
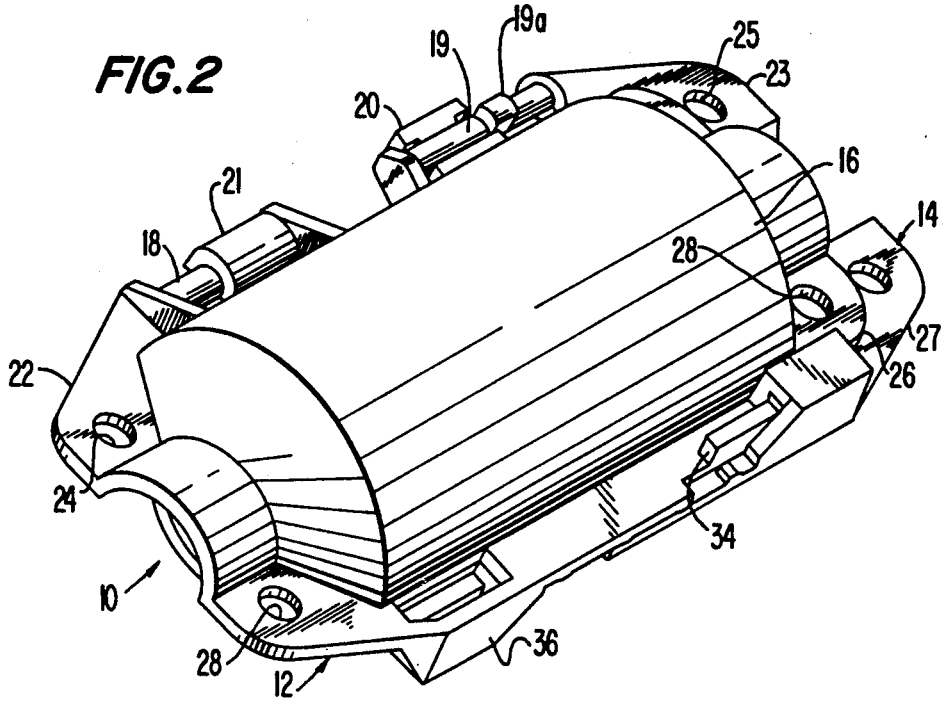
FIG. 2 is a perspective view of the lockout device of FIG. 1 in a partly closed position.
Figure 3:
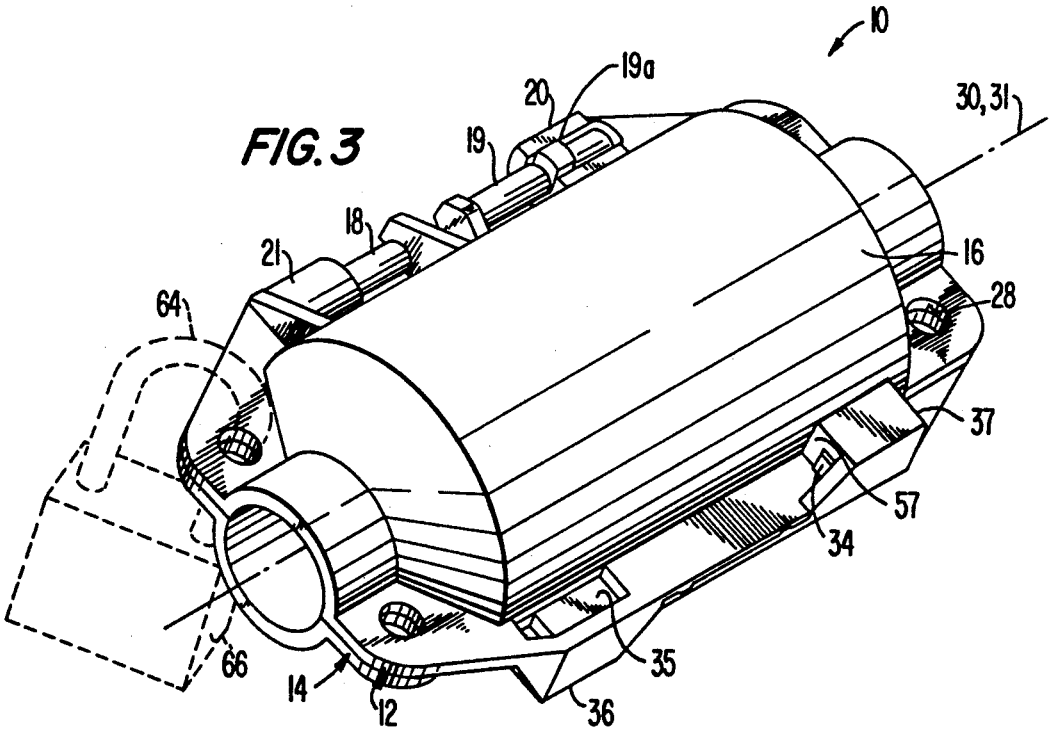
FIG. 3 is a perspective view of the device of FIGS. 1 and 2 in a fully closed position forming a lockout housing.

Each shell portion includes a hinge pin 18, 19 (FIGS. 2 and 3) as well as hinge clevis means 20, 21 which is shaped to partially surround and engage the hinge pin on the other, mating shell portion. The hinge pin and clevis on each shell portion is formed along one side edge of the shell portion along with a flange 22, 23 which extends axially outwardly from the cylindrical body. Flanges 22 and 23 preferably are provided at both ends of each shell portion and are provided with openings 24, 25 through which the shackles of one or more locks can be inserted when the shell portions are fully assembled with each other such that these openings are aligned.

On the other side of each shell portion is a flange 26, 27 extending laterally and axially away from the body, this flange also having openings 28, 29 to receive the shackle of a lock. In many circumstances, only one lock might be used, but a plurality of openings are provided primarily to permit the use of plural locks if several service people are working on the same equipment at the same time or during overlapping times. Multiple openings also provide convenient alternative locations for the lock on the assembled housing and another such opening, not used for a lock, can be used to attach a suitable tag. Flange 26, 27 is formed so that it carries male and female portions of a latch means positioned so that such portions can engage the mating latch means on the other shell portion. Thus, flange 27, which lies in a plane parallel with the longitudinal central axis 31 of the shell portion carries a protruding male latch member 35 and a generally U-shaped female latch member 37. Similarly, flange 26 carries a male latch member 34 (FIGS. 2 and 3) and a female latch member 36. Flanges 26 and 27 also carry detent structures including a small protrusion 38, 39 and a small indentation 40, 41 to hold the assembled shell portions in their proper axial position and to provide a "snap fit" so that it will be apparent to the user when full assembly has taken place.

Between the respective flanges at opposite ends of each shell portion is an arcuate sleeve defining an arcuate recess 44, 45. When the shell portions are joined, the coupled recesses define cylindrical openings at opposite ends of the shell surrounding the central axis of the assembled housing so that an electrical cable attached to a connector received within the housing can pass outwardly therefrom. Also, providing openings at both ends allows the cable to be passed entirely through the housing so that the housing can be stored on the cable between uses.

Figure 4:
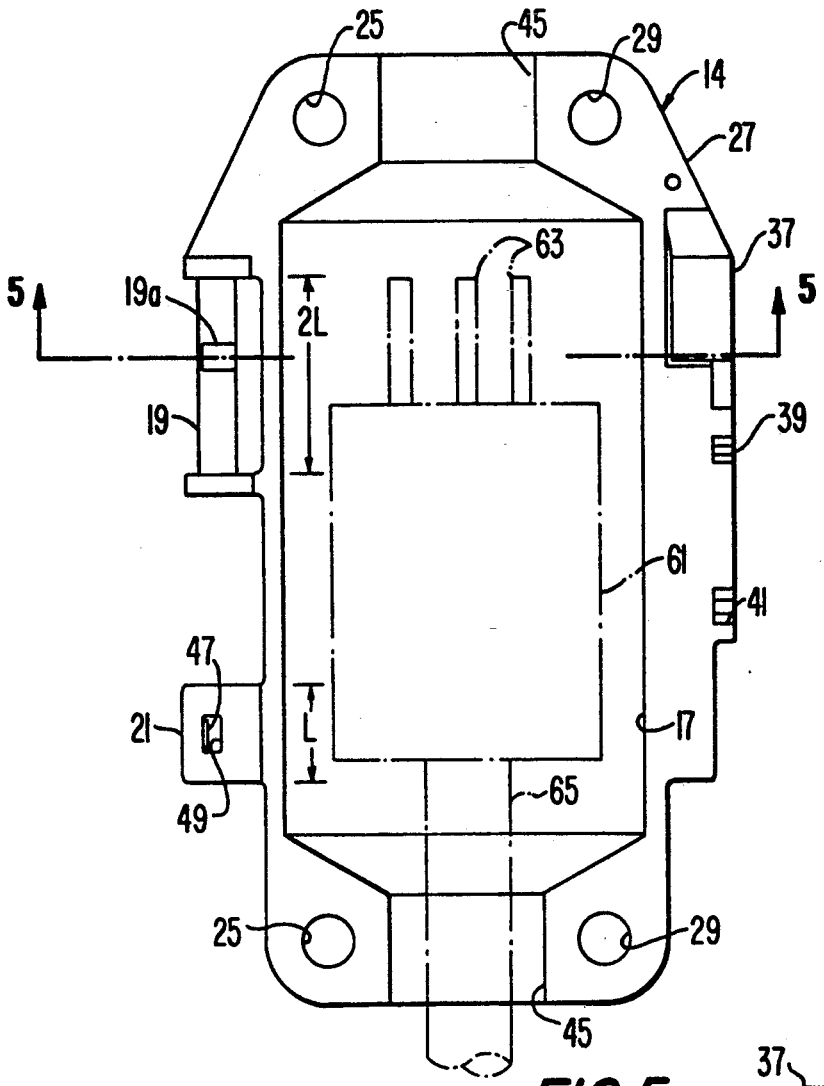
FIG. 4 is a top plan view of one shell portion of the device of FIGS. 1–3 showing the interior surface thereof.
Figure 5:
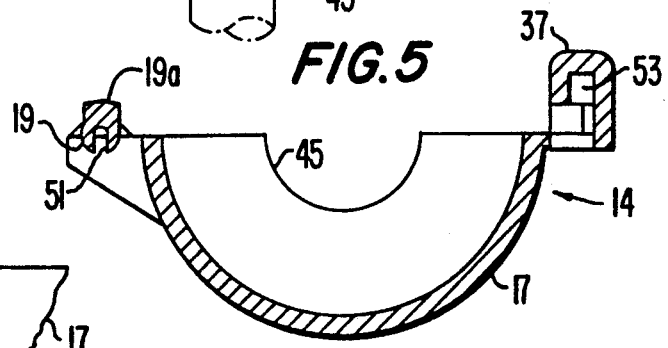
FIG. 5 is a transverse sectional view along line 5–5 of FIG. 4.
Figure 6A:
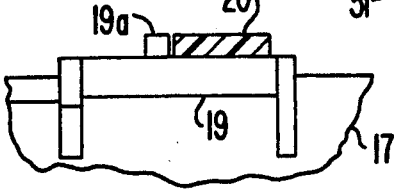
FIG. 6A is a partial side elevation of a hinge pin of the structure of FIG. 4.
Figure 6:
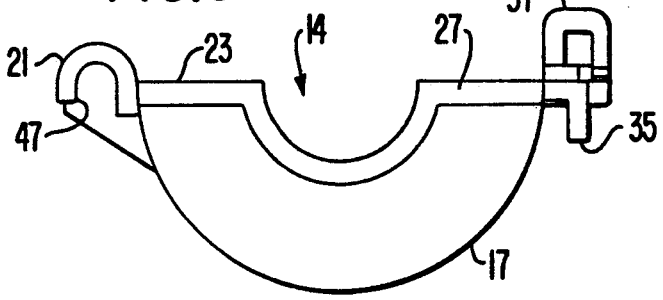
FIG. 6 is an end elevation of the shell portion of FIG. 4.

The details of the structure thus far described can be seen more clearly with reference to FIGS. 4–7 in which plan and elevation views of shell portion 14, by itself, are shown. As best seen in FIG. 4, the hinge clevis has an axial length L which is substantially equal to about one half of the length of hinge pin 19. This permits the clevis to be snapped over the hinge pin of the mating shell portion at one end thereof and then moved axially toward the other end of the hinge pin, an assembly step which will be described further in connection with the latch means. As seen in FIGS. 4 and 6, the clevis is a downwardly (in FIG. 6) opening, generally U-shaped member having a snap tab 47 adjacent the open end thereof, tab 47 being visible in FIG. 4 through an opening 49 which is formed in the clevis member to facilitate molding the latch tab. The latch tab is dimensioned so that the opening at the mouth of the clevis member is slightly smaller than the outer diameter of the hinge pin, requiring that the clevis member be slightly elastically deformed as the portions are assembled and tending to keep the members in the assembled condition. As seen in FIG. 5, hinge pin 19 is formed with a longitudinal slot 51 to make the hinge pin elastically deformable to cooperate with the clevis member in the assembly process.

FIG. 6A shows the hinge pin in greater detail, the pin being shown with a sectioned part of a clevis 20 engaging the pin as in the position of FIG. 1. The portion of the hinge pin engaged by the clevis in FIG. 6A is cylindrical, but the remainder of the pin is formed with an enlargement **19*a* which makes it non-circular. Clevis 20 is therefore prevented from moving axially along the hinge pin until the shell portions are closed to the position shown in FIGS. 2 and 7. In that position, the opening of the clevis embraces enlargement 19*a* and is axially movable along the hinge pin to the position shown in FIG. 3. Pin 18 is, of course, similarly formed with an enlargement 18*a***.

Turning now to the latch means, the female latch portion 37, best seen in FIGS. 4, 5, and 6 includes a generally U-shaped portion having an interior cavity 53 which is shaped to receive the male latch member on the mating shell portion. Cavity 53 is at least partially closed on all sides except in the axial direction from which the male portion can be inserted. It will be observed in FIG. 7 that the male member 35 and the female member 37 are on opposite sides of flange 27 and that flange 27 terminates in an end wall 55 which is axially spaced from the end of the shell so that an end face 58 of female latch member 36 on shell portion 12 will pass end surface 55 of the male latch member 35 as the shells are closed, allowing the male member to be in a position to enter female latch member 36. Similarly, flange 26 is cut away adjacent end surface 56 of male latch member 34 so that surface 56 can pass surface 57 of female latch member 37. Then, as will be seen from FIG. 7 and FIG. 2, when the shell portions are moved axially relative to each other in the direction of the arrows in FIG. 7, the male latch members enter the female latch members and the detent protrusions 38 and 39 enter the detent recesses 40 and 41, respectively, securely latching the shell portions into a single housing. In that condition, the lock openings are aligned and the shackle 64 of a lock 66 can be inserted therethrough to prevent axial movement in the opposite direction. The housing can then only be opened after the lock has been removed.

FIG. 4 illustrates a typical connector 61, shown in dash-dot lines, having conductive prongs 63 and a cable 65 as it might be positioned within the housing including shell portion 14. Clearly, the cable 65 must be of a maximum diameter small enough to fit through the cable axis openings formed by surfaces 44 and 45 and the connector housing itself must be larger than that diameter so that the connector cannot be removed from the housing without first removing the lock.

Figure 7:
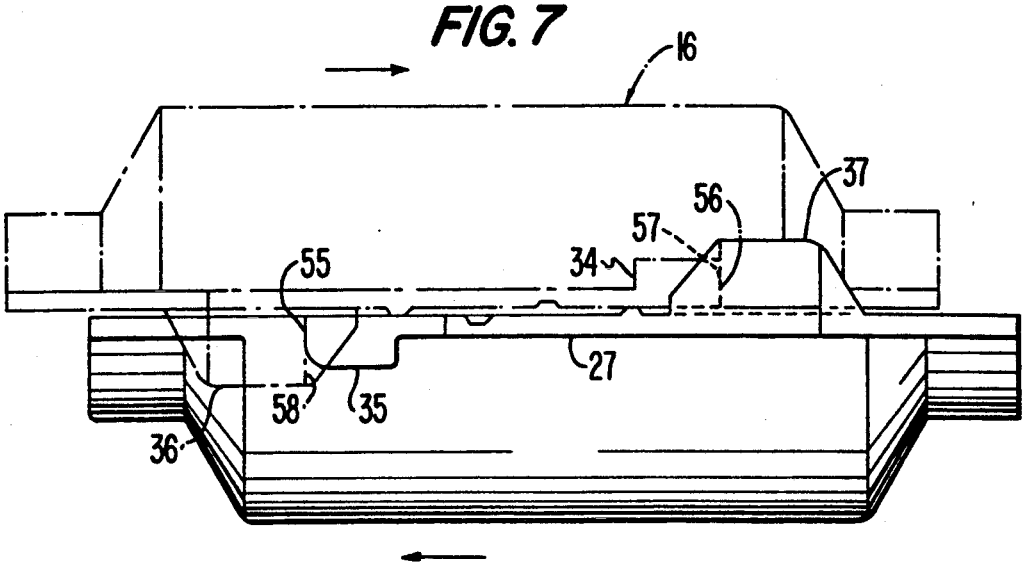
FIG. 7 is a side elevation of the shell portion of FIG. 4 with a mating shell portion shown in phantom lines.

As will be recognized particularly from FIGS. 1, 4, and 7, two shell portions as shown in FIG. 4, which are identical to each other, are positioned for assembly by placing the shell portions adjacent each other with the concave surfaces of their cylindrical bodies facing in the same direction as shown in FIG. 1 and with the shell portions oriented so that the half-hinges, i.e., the hinge pin and hinge clevis on each shell, are adjacent each other and so that the latch sides are farthest apart. With the shell portions offset axially so that the male and female latch portions can clear each other, the shell portions are pressed together, causing the clevis members to snap around the hinge pins. The shell portions are then relatively pivotable and the resulting housing can be open and closed. A connector 61 is then placed in one of the shell portions with its cable extending out of the end, and the housing is closed. The shell portions are then moved axially with respect to each other, as described in connection with FIG. 7, until the latch means engage each other, whereupon a lock is applied as described above.

While one advantageous embodiment has been chosen to illustrate the invention, it will be understood by those skilled in the art that various changes and modifications can be made therein without departing from the scope of the invention as defined in the appended claims.

What is claimed is:

1. A lockout device for enclosing and inhibiting unauthorized access to an electrical connector attached to an electrical cable, the device comprising the combination of first and second shell portions joinable along edges thereof, each said shell portion having a hollow interior which, when joined with the other shell portion, defines a cavity having a central longitudinal axis for receiving said electrical connector, said first shell portion further comprising a hinge pin extending generally axially along an edge thereof, said second shell portion comprising hinge clevis means for releasably receiving said hinge pin on said first shell portion to pivotally join said shell portions so that they are movable between open and closed positions, and each said shell portion comprising latch means engageable with said other shell portion to hold said shell portions in said closed position, said latch means comprising means defining an axially opening latch recess and a protruding latch dog, said latch recess on one shell portion being positioned to receive said latch dog on said other shell portion when said portions are placed together and moved axially relative to each other.

2. A device according to claim 1 wherein each said shell portion includes and outwardly extending flange having means defining openings to receive a lock to hold said shell portions in the joined, closed position.

3. A device according to claim 1 wherein each said shell portion further comprises means defining an arcuate recess at an end of each said shell portion, said recesses of two joined shell portions forming a generally circular opening for a cable connected to said connector contained in said cavity.

4. A device according to claim 3 wherein each said shell portion includes means defining said arcuate recesses at both ends.

5. A device according to claim 1 wherein said hinge clevis means includes means defining a U-shaped recess opening in a direction opposite to the opening direction of said hollow interior and having an axial length L, said hinge pin extends axially and has a length greater than L, whereby said shell portions can be moved axially relative to each other after said pin and clevis are joined.

6. A device according to claim 5 wherein each said shell portion includes and outwardly extending flange having means defining openings to receive a lock to hold said shell portions in the joined, closed position.

7. A method of enclosing an electrical connector attached to an electrical cable to inhibit unauthorized access to the connector comprising the steps of forming a pair of shell members, one said shell member having a male half-hinge on one side, the other shell member having a female half-hinge on one side, and each said shell member having axially engageable latches on the other side, a generally arcuate opening at an end and a lock opening, placing the shell members together so that the latch on each shell member is adjacent the latch on the other shell member, joining the half-hinges to form an openable and closable housing in which the lock openings are aligned in the closed position, opening the housing thus formed and inserting a connector with the cable attached thereto extending out of the housing through the arcuate openings at the end, closing the housing the enclose the connector, and inserting the shackle of a lock through the aligned openings to thereby inhibit access to the connector.

* * * * *